US011022084B2

(12) United States Patent
Kim et al.

(10) Patent No.: US 11,022,084 B2
(45) Date of Patent: Jun. 1, 2021

(54) VEHICLE FUEL INJECTOR

(71) Applicant: HYUNDAI KEFICO CORPORATION, Gunpo-Si (KR)

(72) Inventors: Hyung Ik Kim, Seoul (KR); Dong Hyun Kim, Gyeonggi-do (KR); Hyun Jick Lee, Gyeonggi-do (KR)

(73) Assignee: HYUNDAI KEFICO CORPORATION, Gyeonggi-do (KR)

( * ) Notice: Subject to any disclaimer, the term of this patent is extended or adjusted under 35 U.S.C. 154(b) by 0 days.

(21) Appl. No.: 16/937,971

(22) Filed: Jul. 24, 2020

(65) Prior Publication Data

US 2021/0025363 A1 Jan. 28, 2021

(30) Foreign Application Priority Data

Jul. 25, 2019 (KR) ..... 10-2019-0090454

(51) Int. Cl.

| | |
|---|---|
| ***F02M 61/18*** | (2006.01) |
| ***F02M 61/14*** | (2006.01) |
| ***F02M 51/06*** | (2006.01) |
| ***F02M 55/02*** | (2006.01) |
| ***F02M 61/08*** | (2006.01) |

(52) U.S. Cl.

CPC .... *F02M 61/1806* (2013.01); *F02M 51/0603* (2013.01); *F02M 51/0614* (2013.01); *F02M 55/025* (2013.01); *F02M 61/08* (2013.01); *F02M 61/14* (2013.01); *F02M 61/1893* (2013.01)

(58) Field of Classification Search

CPC ..... F02M 61/1806; F02M 61/1893; F02M 61/08; F02M 61/14; F02M 55/025; F02M 51/0603; F02M 51/0614

USPC ..... 123/467, 470, 490; 239/533.12

See application file for complete search history.

(56) References Cited

FOREIGN PATENT DOCUMENTS

| | | | |
|---|---|---|---|
| JP | 08-232810 | A | 9/1996 |
| JP | 10-318097 | A | 12/1998 |
| JP | 3296212 | B2 | 6/2002 |
| KR | 10-1998-0049400 | A | 9/1998 |
| WO | 00/22295 | A1 | 4/2000 |

OTHER PUBLICATIONS

Office Action dated May 25, 2020 in corresponding Korean Patent Application No. 10-2019-0090454.

*Primary Examiner* — Hai H Huynh

(74) *Attorney, Agent, or Firm* — Mintz Levin Cohn Ferris Glovsky and Popeo, P.C.; Peter F. Corless

(57) ABSTRACT

A vehicle fuel injector is configured to inject a high-pressure vehicle fuel received from a fuel rail into a combustion chamber. The vehicle fuel injector includes a nozzle which includes a plurality of discharge flow paths which are disposed to be spaced apart from each other in a circumferential direction and pass through the nozzle in a longitudinal direction, and outward flow paths formed on an inner circumferential surface of the nozzle, the nozzle having a hollow shape, and a needle bar which is formed to pass through the inner circumferential surface of the nozzle and vertically reciprocally moves on the inner circumferential surface of the nozzle, where rotation of the needle bar is adjusted in a left or right direction so that the nozzle is opened or closed.

20 Claims, 16 Drawing Sheets

VEHICLE FUEL INJECTOR

CROSS-REFERENCE TO RELATED APPLICATION

This application claims under 35 U.S.C. § 119(a) the benefit of Korean Patent Application No. 10-2019-0090454, filed on Jul. 25, 2019, the entire contents of which are incorporated by reference herein.

BACKGROUND

1. Technical Field

The present disclosure relates to a gasoline direct injection (GDI) type fuel injector, more specifically, to a vehicle fuel injector having a nozzle in which an outward flow path and a multi-hole type discharge flow path are mixed.

2. Description of the Related Art

As emission regulations are tightened worldwide, technical developments have been achieved to improve fuel economy and achieve low pollutant emissions.

A carbon dioxide ($CO_2$) reduction technology, which is one of these technical developments, includes a technology for reducing a fuel consumption amount of a gasoline engine, that is, technology for reducing a pump loss, improving combustion efficiency, reducing a mechanical loss, and the like.

Recently, with the development of next-generation gasoline engine combustion technology that allows drastic reductions in a fuel consumption rate, there is a trend toward development of a lean-burn direct injection engine.

Existing multi-hole type nozzles have high injection targeting performance but suffer from a long injection reach distance resulting in wall wetting fuel streams on cylinder liners/piston heads when fuel is injected into combustion chambers.

In addition, the multi-hole type nozzle may generate fine dust such as particulate matters (PMs), particle numbers (PNs), and nitrogen oxide (NOx) according to emission standards.

Meanwhile, an outward type nozzle is capable of easily being opened or closed using a relatively small force with the aid of oil pressure when a needle is opened, and fuel is injected in a jar shape so that an injection reach distance is short and there is an advantage of generating a mixture.

However, the outward type nozzle has problems in that it is difficult to perform correct targeting due to a shape of a combustion chamber, and it is difficult to generate eddy kinetic energy using a fuel jet.

As a result, in a case in which it is difficult to generate a uniform mixture and a wall wetting fuel stream occurs in all the above described nozzles, a knocking phenomenon may be generated due to occurrence of local combustion, and exhaust emissions, such as fine dust, may also be generated.

SUMMARY

The present disclosure is directed to reducing a wall wetting fuel stream phenomenon in a combustion chamber using a nozzle in which an outward flow path and a multi-hole type discharge flow path are mixed to reduce exhaust emissions and prevent a knocking phenomenon.

The technical objectives of the present disclosure are not limited to the above, and other objectives may become apparent to those of ordinary skill in the art based on the following description.

A vehicle fuel injector according to one embodiment of the present disclosure is provided for injecting a high-pressure vehicle fuel received from a fuel rail into a combustion chamber.

The vehicle fuel injector includes a nozzle which includes a plurality of discharge flow paths which are disposed to be spaced apart from each other in a circumferential direction and pass through the nozzle in a longitudinal direction, and outward flow paths formed on an inner circumferential surface of the nozzle, the nozzle having a hollow shape, and a needle bar which is formed to pass through the inner circumferential surface of the nozzle and vertically reciprocally moves on the inner circumferential surface of the nozzle, wherein rotation of the needle bar is adjusted in a left or right direction so that the nozzle is opened or closed.

The nozzle may include a guide protrusion formed to protrude from the inner circumferential surface of the nozzle, the needle bar may include a guide groove corresponding to the guide protrusion on an outer circumferential surface of the needle bar, and the guide groove may be concavely formed to be inclined in a downward direction and adjust a rotation angle of the needle bar.

The guide groove may include a vertical groove having a vertical section on the outer circumferential surface of the needle bar, and an inclined groove formed to extend from the vertical groove and inclined in a left or right direction with respect to the vertical groove.

In the nozzle, choking may occur in the discharge flow path so that fuel is injected at a constant speed.

The needle bar may rotate such that the nozzle enters an open state while moving downward, and the needle bar may rotate such that the nozzle enters a closed state while moving upward.

A plurality of blades may be formed to protrude in a width direction on a lower end of the needle bar The blade may include a pair of fins formed to protrude from an upper end surface of the blade and spaced apart from each other to form an acute angle therebetween.

The pair of fins may provide a discharge path of one of the outward flow paths on the blade in an open state of the nozzle and atomize an injected fuel.

The pair of fins may be formed to be detachably attached to an upper end surface of the blade. A tilting groove provided for adjusting installation angles of the fins may be formed on the upper end surface of the blade.

The blade may be formed to be inclined downward, and a lower end portion thereof has a tapered shape.

A guide member which surrounds and supports a circumference of the needle bar to stabilize movement of the needle bar may be formed at a lower end of the inner circumferential surface of the nozzle.

The guide member may be formed to protrude inward at a position corresponding to the discharge flow path in a width direction, and the outward flow paths may be formed at both ends of the guide member in the circumferential direction.

A ring guide which surrounds and supports a circumference of the needle bar to stabilize movement of the needle bar may be formed on an upper end of the inner circumferential surface of the nozzle.

The ring guide may be formed to have a hollow shape of which an inner circumferential surface surrounds the circumference of the needle bar and include a plurality of discharge holes having a concentric circle.

The vehicle fuel injector may further include an armature surrounding an upper circumference of the needle bar, a magnetic core positioned under the armature and disposed around the needle bar, and an elastic member provided between the armature and the magnetic core.

The armature may move downward in a direction toward the magnetic core due to a magnetic field generated in a solenoid coil, and the needle bar may move vertically in conjunction with the armature.

A non-magnetic body may be provided at a partial section between the armature and the solenoid coil.

A stopper disposed above the armature and a position ring disposed under the armature may be formed on the upper circumference of the needle bar, and the stopper and the position ring may be formed to be spaced apart from each other to restrict a movement range of the armature.

When a magnetic force is not applied to the armature, the armature may move upward due to the elastic member.

A vehicle fuel injector according to another embodiment of the present disclosure includes a nozzle which includes a plurality of discharge flow paths which are disposed to be spaced apart from each other in a circumferential direction and pass through the nozzle in a longitudinal direction, and outward flow paths formed on an inner circumferential surface of the nozzle, the nozzle having a hollow shape, a needle bar which is formed to pass through the inner circumferential surface of the nozzle and vertically reciprocally moves on the inner circumferential surface of the nozzle, wherein rotation of the needle bar is adjusted in a left or right direction so that the nozzle is opened or closed, and a piezo actuator connected to an upper end of the needle bar to control movement of the needle bar.

The vehicle fuel injector may include a fixing plate which surrounds an upper circumference of the needle bar, and an elastic member which is provided between the fixing plate and an upper end of the nozzle and provides an elastic force.

A ring guide which surrounds and supports a circumference of the needle bar to stabilize movement of the needle bar may be formed on an upper end of the inner circumferential surface of the nozzle.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
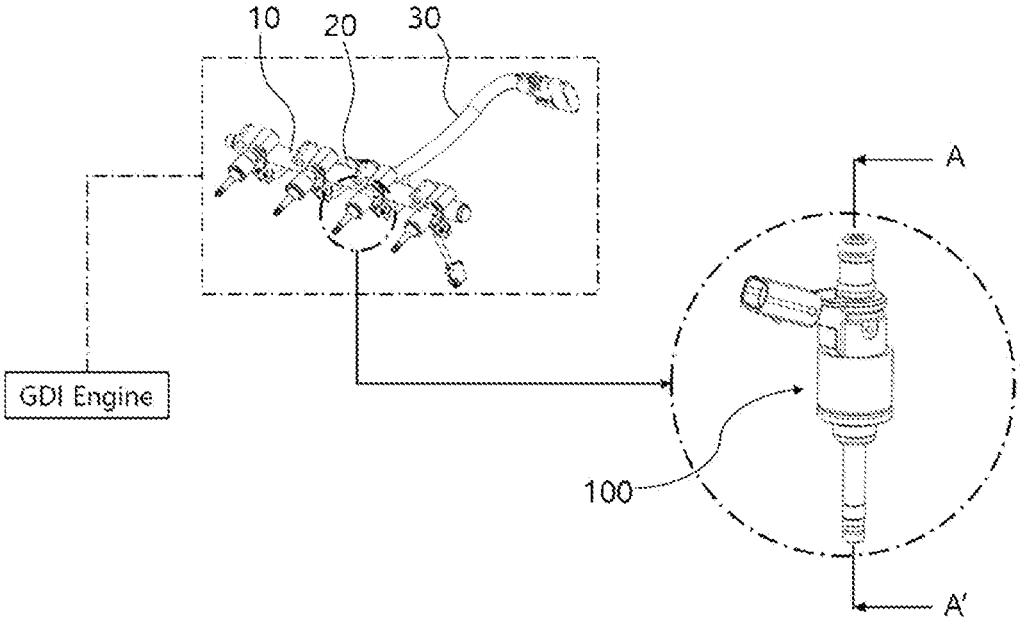
FIG. 1 is a conceptual view illustrating a vehicle fuel injector according to one embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the disclosure. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Throughout the specification, unless explicitly described to the contrary, the word "comprise" and variations such as "comprises" or "comprising" will be understood to imply the inclusion of stated elements but not the exclusion of any other elements. In addition, the terms "unit", "-er", "-or", and "module" described in the specification mean units for processing at least one function and operation, and can be implemented by hardware components or software components and combinations thereof.

Further, the control logic of the present disclosure may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

Advantages and features of the present disclosure and methods of achieving the same will be clearly understood through embodiments described in detail with reference to the accompanying drawings. However, the present disclosure is not limited to the embodiments to be disclosed below but may be implemented in various different forms. The embodiments are provided in order to fully explain the present disclosure and fully explain the scope of the present disclosure for those skilled in the art. The scope of the present disclosure is defined by the appended claims. Meanwhile, the terms used herein are provided only to describe the embodiments of the present disclosure and not for purposes of limitation.

Hereinafter, exemplary embodiments of the present disclosure will be described in detail with reference to the accompanying drawings.

FIG. 1 is a conceptual view illustrating a vehicle fuel injector according to one embodiment of the present disclosure.

Referring to FIG. 1, a vehicle fuel injector 100 is a device provided for injecting a high-pressure vehicle fuel supplied through a fuel rail 10 into a combustion chamber (not shown).

That is, the vehicle fuel injector 100 receives an electrical signal from an electronic control unit (ECU) and injects the high-pressure fuel into the combustion chamber of a gasoline direct injection (GDI) engine.

To this end, the vehicle fuel injector 100 is coupled to the fuel rail 10 and connected to a high-pressure sensor 20 and a wire harness 30 and receives power from an external power source to operate. In this case, an airtight member (O-ring) may be provided on an upper end of a portion at which the vehicle fuel injector 100 is coupled.

The vehicle fuel injector 100 injects a correct amount of fuel into the combustion chamber at an appropriate time.

Generally, fuel in a liquid state is atomized, mixed with air to form a mixture, and introduced into the combustion chamber during an intake stroke of an engine (not shown), and such a mixture generation process is an important factor to define a combustion phenomenon of a cylinder (not shown).

Entire processes of vaporization, mixing with air, and ignition and combustion of the fuel are almost simultaneously performed.

An objective of forming the mixture is that the vaporized fuel self-ignites as soon as possible, and the injected fuel is completely burnt while avoiding a high peak-combustion temperature.

When the two basic conditions are satisfied, combustion may be performed in which a level of harmful emissions is low while avoiding excessive pressure rise, high combustion noise, and a mechanical/thermal load.

To this end, the vehicle fuel injector 100 according to one embodiment of the present disclosure uses a nozzle in which an outward flow path and a multi-hole type discharge flow path are mixed. Therefore, the vehicle fuel injector 100 according to the present disclosure can inject fuel to a suitable injection reach distance and improve injection targeting performance. Detailed explanations will be described below.

Figure 2:
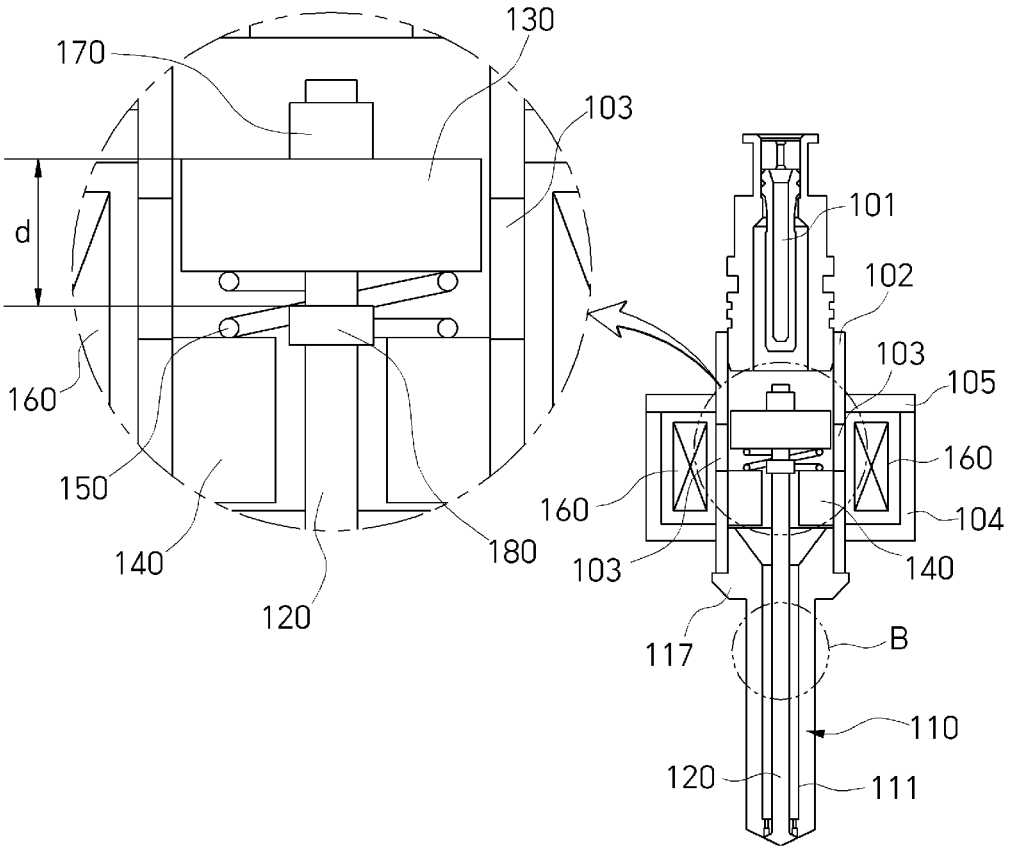
FIG. 2 is a cross-sectional view taken along line A-A' shown in FIG. 1.

FIG. 2 is a cross-sectional view taken along line A-A' shown in FIG. 1.

Referring to FIG. 2, basically, the vehicle fuel injector 100 receives an electrical signal using an electromagnet, and a needle bar 120 vertically moves on an inner circumferential surface of a nozzle 110 to open or close an output side of the nozzle 110.

The vehicle fuel injector 100 according to the present disclosure includes components included in a conventional GDI type fuel injection system with a high-pressure pump (not shown) which constantly compresses fuel and the fuel rail 10 (see FIG. 1) which stores the compressed fuel and through which the compressed fuel is supplied to the vehicle fuel injector 100.

The vehicle fuel injector 100 mainly includes a filter 101, a support tube 102, the nozzle 110, the needle bar 120, an armature 130, a magnetic core 140, an elastic member 150, and a solenoid coil 160.

In this case, the above-described components are provided for injecting a vehicle fuel and have mechanisms operating in conjunction with each other.

Before the components of the present disclosure are described in detail, a structure in which the needle bar 120 moves vertically and rotates and the related components for operating the needle bar 120 will be described.

However, the vehicle fuel injector 100 according to the present disclosure injects a vehicle fuel into the combustion chamber and has the same structure as the conventional vehicle fuel injector except for specific features thereof. Accordingly, in the specification, differences of the present disclosure from a conventional fuel injector will be described in detail.

The nozzle 110 is provided for injecting a vehicle fuel and preferably has a hollow shape. The nozzle 110 preferably includes a plurality of discharge flow paths 111 and a plurality of outward flow paths 112.

The discharge flow paths 111 are disposed at intervals in a circumferential direction of the nozzle 110. The discharge flow paths 111 are formed to pass through the nozzle 110 in a longitudinal direction thereof and formed as a plurality of holes.

The outward flow paths 112 are formed on the inner circumferential surface of the nozzle 110. The outward flow paths 112 may be easily opened or closed with a relatively small force with the help of hydraulic pressure.

In addition, fuel is injected into the combustion chamber to have a jar shape through the outward flow paths 112. Accordingly, when the outward flow paths 112 are used, an injection reach distance is short and a risk of generating a wall wetting fuel stream is low so that it is advantageous for forming a mixture.

A general multi-hole type flow path is advantageous for injection targeting because of a long injection reach distance. However, due to the advantage, there is a high possibility of generating a wall wetting fuel stream because the injection reach distance is relatively long.

In order to solve such a problem, the multi-hole type discharge flow paths 111 and the outward flow paths 112 are simultaneously applied to the nozzle 110 in the present disclosure.

The injection reach distance of fuel injected into the combustion chamber through the discharge flow paths is shortened by injecting the fuel into the combustion chamber through the outward flow paths 112. This reduced injection reach distance is because a pressure is distributed by the fuel injected through the outward flow paths 112.

Accordingly, the injection reach distance of the fuel passing through the discharge flow paths 111 is decreased due to the pressure distribution of the fuel injected through the outward flow paths 112, and thus the present disclosure may prevent generation of the wall wetting fuel stream. That is, the nozzle 110 may maintain the targeting performance of the discharge flow paths 111 and also prevent the generation of the wall wetting fuel stream.

The needle bar 120 is provided as a structure passing through the inner circumferential surface of the nozzle 110.

The needle bar 120 vertically moves on the inner circumferential surface of the nozzle 110, and rotation thereof is adjusted in a left or right direction so that the nozzle 110 is opened or closed.

As the needle bar 120 moves downward, the needle bar 120 rotates in an open state, and as the needle bar 120 moves upward, the needle bar 120 rotates in a closed state.

Next, components provided for operating the needle bar 120 operating in conjunction with the nozzle 110 will be described.

First, the armature 130 surrounds an upper circumference of the needle bar 120. The armature 130 has a function for electrical-mechanical energy converting, circuit opening or closing, and the like through rotation or movement.

The armature 130 moves downward in a direction toward the magnetic core 140 due to a magnetic field generated in the solenoid coil 160. In this case, the needle bar 120 is vertically moved in conjunction with the armature 130.

In this case, non-magnetic bodies 103 are provided in some sections between the armature 130 and the solenoid coil 160 to focus a magnetic density thereof.

The non-magnetic bodies 103 are inserted into the support tube 102 positioned between the filter 101 and the nozzle 110.

The magnetic core 140 is positioned under the armature 130 and disposed around the needle bar 120.

The elastic member 150 is a spring which provides an elastic force and is disposed between the armature 130 and the magnetic core 140.

When the armature 130 receives an electrical signal from an external device and moves downward, the elastic member 150 is folded until the armature 130 comes into contact with the magnetic core 140.

Next, when the armature 130 does not receive the electrical signal, the elastic member 150 moves the armature 130 to an upper portion which is an original position (initial position) using an elastic restoring force.

A stopper 170 and a position ring 180 are disposed to be spaced apart from each other on the upper circumference of the needle bar 120.

The stopper 170 is positioned at an upper end of the needle bar 120 and positioned above the armature 130. The armature 130 is prevented from moving upward due to an installation position of the stopper 170.

The position ring 180 is disposed under the armature 130. The armature 130 is prevented from moving downward due to the installation position of the position ring 180.

In other words, the stopper 170 and the position ring 180 restrict a vertical movement distance d of the armature 130 so that the armature 130 moves only between the stopper 170 and the position ring 180.

Figure 3A:
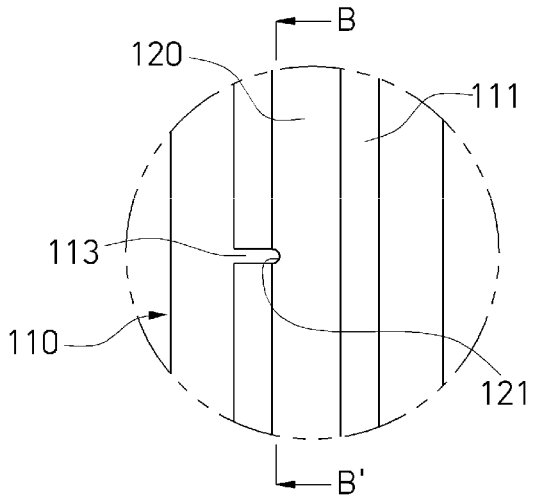
FIG. 3A is a set of partial cross-sectional views illustrating area B shown in FIG. 2.
Figure 3B:
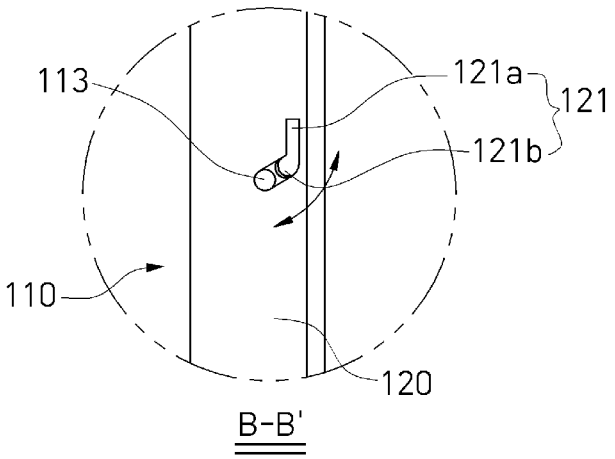
FIG. 3B is a cross-sectional view taken along line B-B' shown in FIG. 3A, FIGS. 4A and 4B are sets of views illustrating a nozzle and a lower end of a needle bar in order to describe an open state and a closed state of the vehicle fuel injector according to one embodiment of the present disclosure.
Figure 4A:
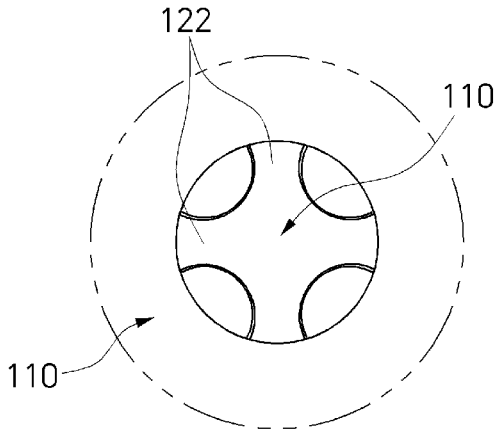
Figure 4B:
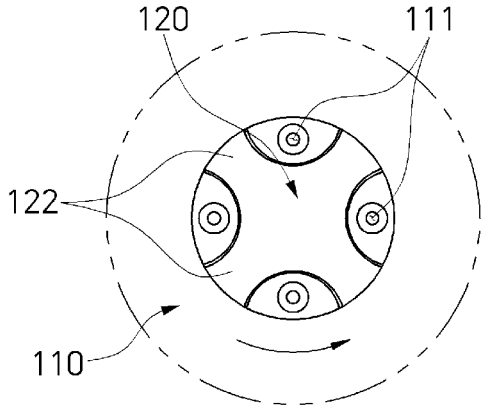

FIG. 3A is a set of partial cross-sectional views illustrating area B shown in FIG. 2; FIG. 3B is a cross-sectional view taken along line B-B' shown in FIG. 3A; and FIGS. 4A and 4B are sets of views illustrating the nozzle and a lower end of the needle bar in order to describe an open state and a closed state of the vehicle fuel injector according to one embodiment of the present disclosure;

Referring to FIGS. 3A and 3B, a guide protrusion 113 is formed to protrude from the inner circumferential surface of the nozzle 110. A guide groove 121 corresponding to the guide protrusion 113 is formed in an outer circumferential surface of the needle bar 120.

In this case, as shown in FIG. 3B, the guide groove 121 is concavely formed to be inclined in a downward direction and adjusts a rotation angle of the needle bar 120.

The guide groove 121 includes a vertical groove 121*a* and an inclined groove 121*b*.

The vertical groove 121*a* is formed as a vertical section in the outer circumferential surface of the needle bar 120.

The inclined groove 121*b* is formed to extend from the vertical groove 121*a*. The inclined groove 121*b* has a structure inclined in the left or right direction with respect to the vertical groove 121*a*.

Rotation of the nozzle 110 and rotation of the needle bar 120 are adjusted by the guide protrusion 113 and the guide groove 121 which operate in conjunction with each other. Rotation of the lower end of the needle bar 120 is adjusted to open or close the nozzle 110.

In FIG. 4A, the closed state of a lower end of the nozzle 110 is maintained by the needle bar 120. In this case, a plurality of blades 122 is formed to protrude from the lower end of the needle bar 120 in a width direction.

The blades 122 are concentric with the inner circumferential surface of the nozzle 110 and rotate to open or close the nozzle 110.

In FIG. 4B, rotation of the needle bar 120 is adjusted such that the lower end of the nozzle 110 enters an open state. As described above, when rotation of the blades 122 of the needle bar 120 is adjusted, the discharge flow path 111, which is one of discharge paths of the nozzle 110, can be opened or closed.

Figure 5A:
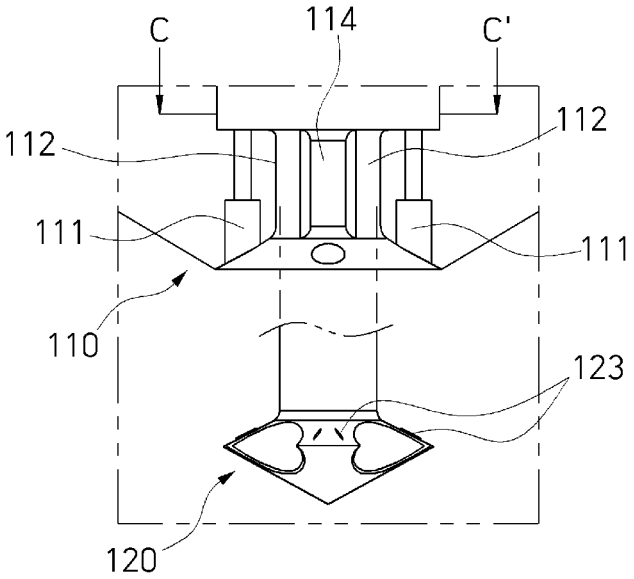
FIGS. 5A and 5B are sets of views illustrating a detailed structure of the nozzle operating in conjunction with the needle bar in the vehicle fuel injector according to one embodiment of the present disclosure.
Figure 5B:
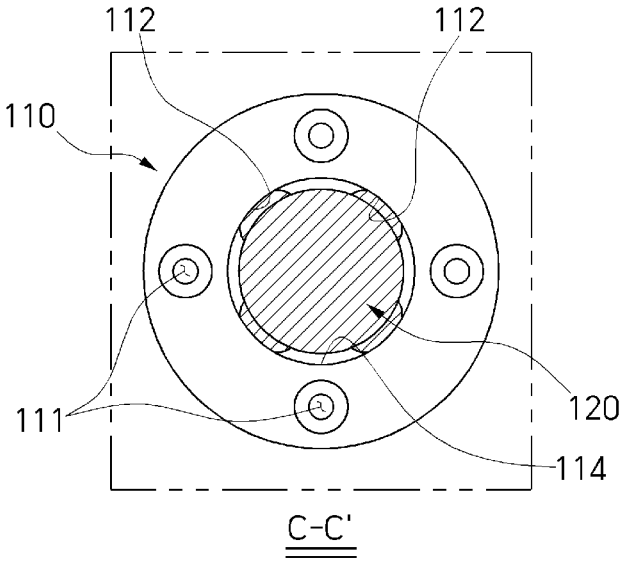

FIGS. 5A and 5B are sets of views illustrating a detailed structure of the nozzle operating in conjunction with the needle bar in the vehicle fuel injector according to one embodiment of the present disclosure.

Referring to FIGS. 5A and 5B, in the nozzle 110, the multi-hole type discharge flow paths 111, the outward flow paths 112, and guide members 114 are integrally formed.

In this case, the guide members 114 surround and support a circumference of the needle bar 120 to stabilize movement of the needle bar 120. The guide members 114 are disposed on a lower end of the inner circumferential surface of the nozzle 110.

The guide members 114 are formed to protrude inward at positions corresponding to the discharge flow paths 111 in the width direction. The outward flow paths 112 are formed at both ends of the guide members 114 in the circumferential direction.

FIGS. 6A to 6C and 7A to 7B are sets of views illustrating a structure which discharges fuel injected through the multi-hole type discharge flow path and the outward flow path in the vehicle fuel injector according to one embodiment of the present disclosure.

Referring to FIGS. 6A to 6C and 7A to 7B, a blade (of the plurality of blades) 122 is provided as a structure being inclined downward, and a lower end portion thereof has a tapered shape.

The nozzle 110 includes flow path grooves 124 at portions close to the blades 122. A vehicle fuel passing through the discharge flow paths 111 and the outward flow paths 112 is injected to the outside through the flow path grooves 124.

In this case, the blade 122 includes a pair of fins 123 formed to protrude from an upper end surface thereof and spaced apart from each other to form an acute angle therebetween.

The pair of fins 123 may provide discharge paths of the outward flow path 112 in an open state of the blade 122 to atomize the injected fuel.

Figure 6A:
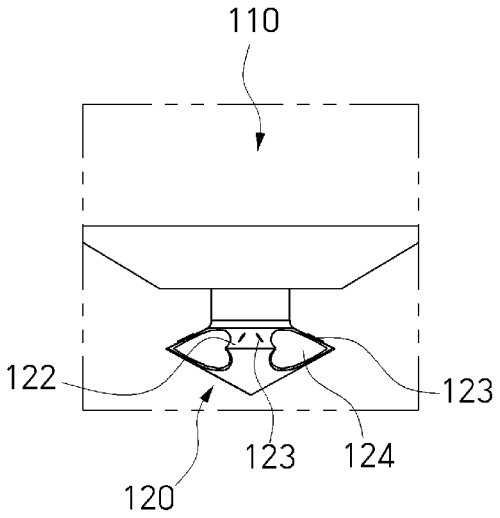
FIGS. 6A to 6C and 7A to 7B are sets of views illustrating a structure which discharges fuel injected through a multi-hole type discharge flow path and an outward flow path in the vehicle fuel injector according to one embodiment of the present disclosure.
Figure 6B:
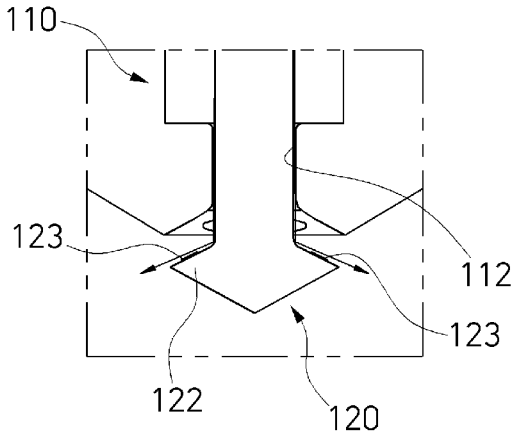
Figure 6C:
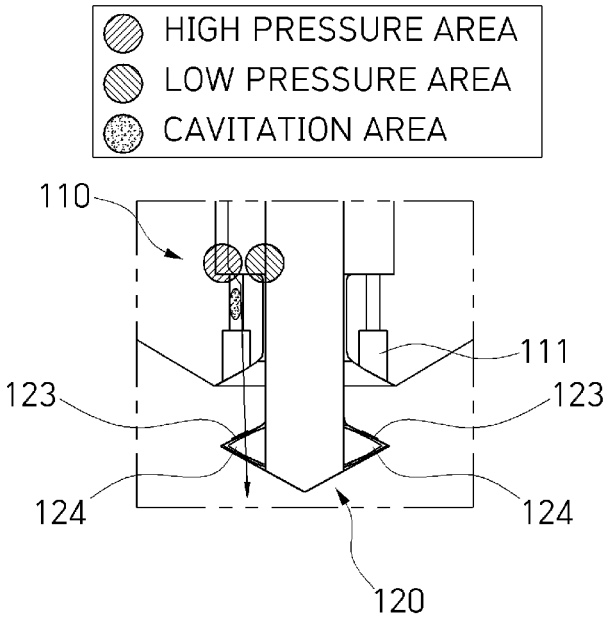

In FIG. 6C, when the needle bar 120 opens the nozzle 110, the discharge flow paths 111 and the outward flow paths 112 (see FIGS. 5A and 5B) are simultaneously opened.

Accordingly, the vehicle fuel injected through the discharge flow paths 111 is injected in a state in which a pressure is lower than that of the conventional multi-hole type nozzle.

Accordingly, a conventional problem of a wall wetting fuel stream in a combustion chamber occurring due to a short injection reach distance of a vehicle fuel can be prevented. In addition, the discharge flow paths 111 may maintain injection targeting.

In other words, cavitation occurs in a vehicle fuel injected through the discharge flow paths 111 which are relatively high-pressure areas on the discharge flow paths 111 so that a velocity of flow is fixed due to choking.

The cavitation occurs due to an internal pressure difference in the discharge flow path 111. The discharge flow path 111 normally operates in a movement area of the cavitation so that an injection speed of the vehicle fuel is fixed.

Figure 7A:
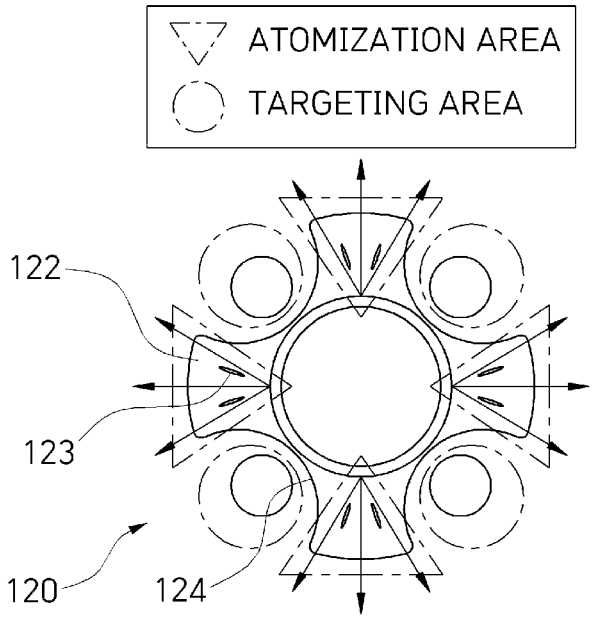

Referring to FIG. 7A, the pair of fins 123 formed on the upper end surface of the blade 122 are spaced apart from each other to form the acute angle.

Accordingly, the pair of fins 123 prevent an injection overlap phenomenon of the vehicle fuel injected through the outward flow path 112 (see FIGS. 5A and 5B).

When the nozzle 110 (see FIGS. 6A to 6C) enters an open state due to rotation of the needle bar 120, the pair of fins 123 atomize the vehicle fuel injected through the outward flow path 112 (see FIGS. 5A and 5B) in each direction to facilitate fission of an initial droplet.

The pair of fins 123 may also be formed to be detachably attached to the upper end surface of the blade 122.

In this case, tilting grooves (not shown) provided for adjusting installation angles of the fins 123 may be formed on the upper end surface of the blade 122.

Accordingly, when the angle between the fins 123 is changed according to a shape of the combustion chamber, mist of the vehicle fuel may be distributed slightly more to an area in which a tumble flow is strong.

Figure 7B:
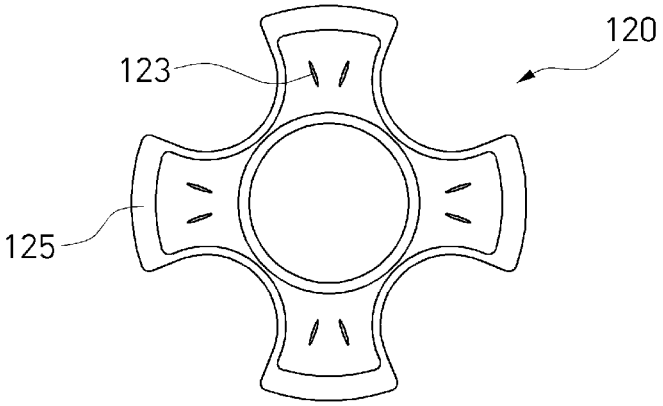
Figure 8A:
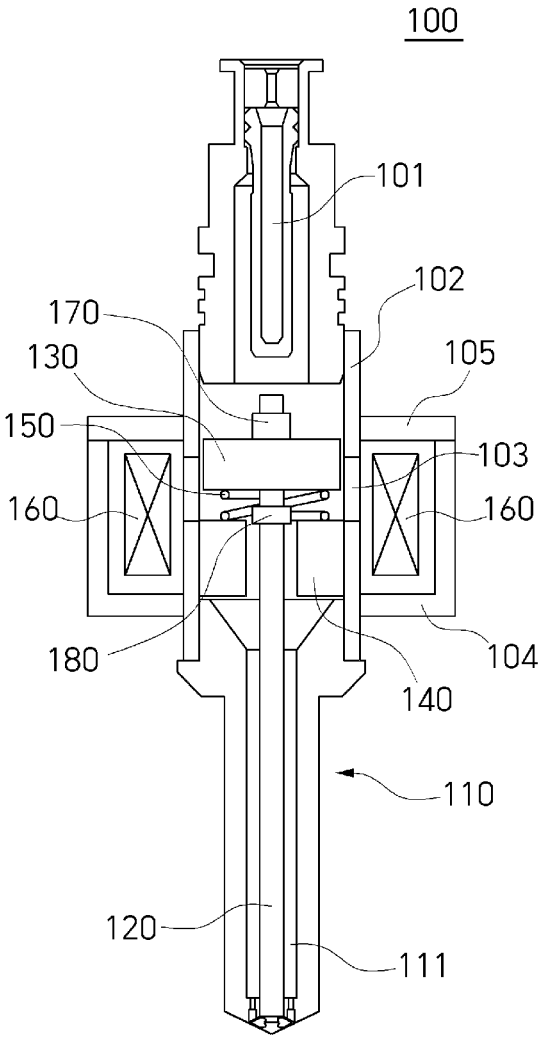
FIGS. 8A to 8E are sets of views illustrating operation mechanisms of the vehicle fuel injector according to one embodiment of the present disclosure.
Figure 8B:
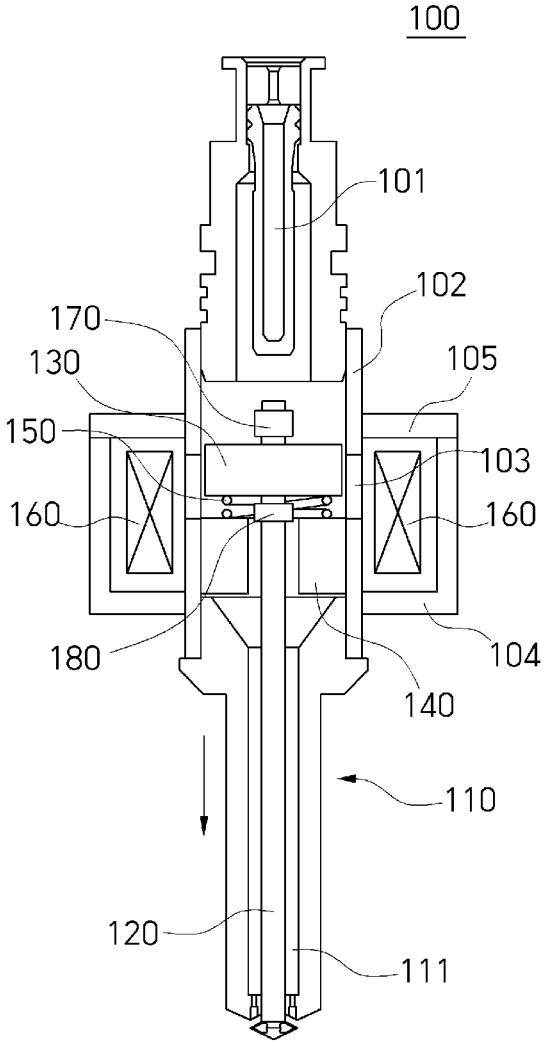
Figure 8C:
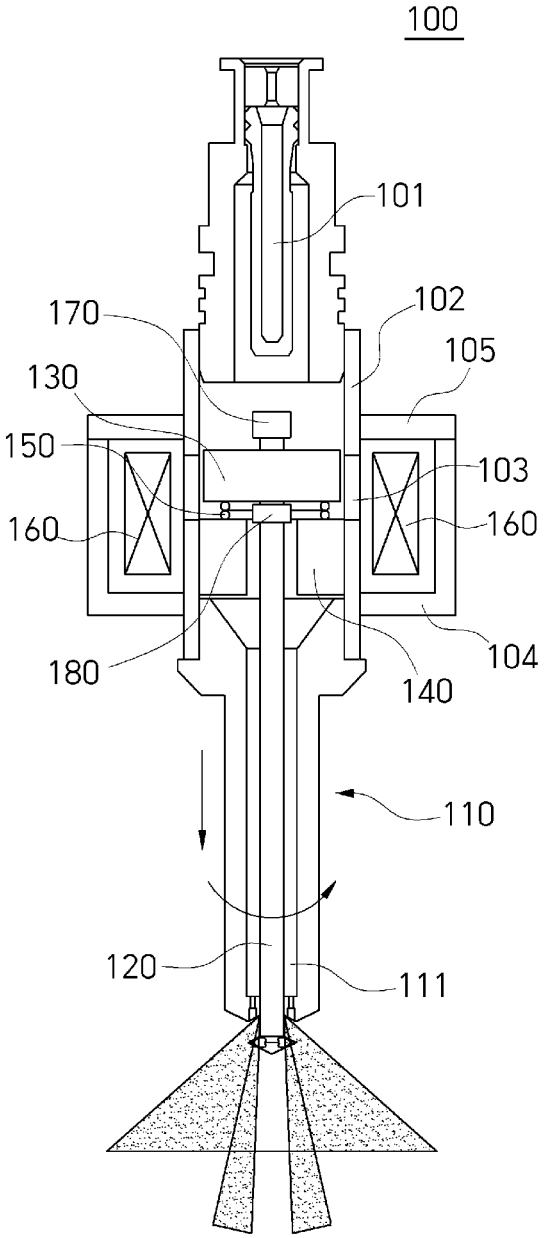
Figure 8D:
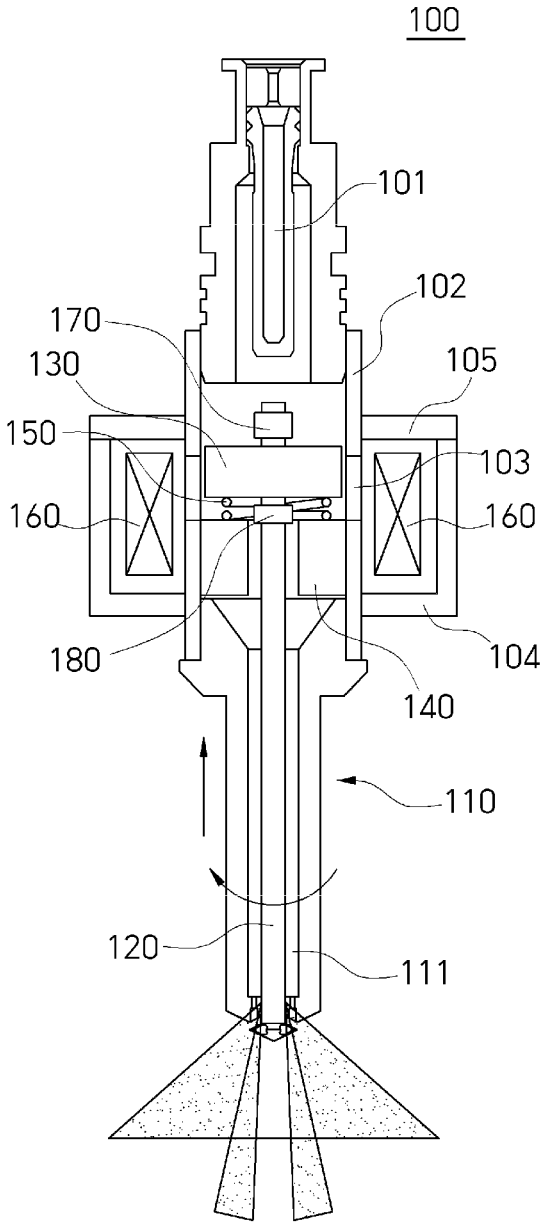
Figure 8E:
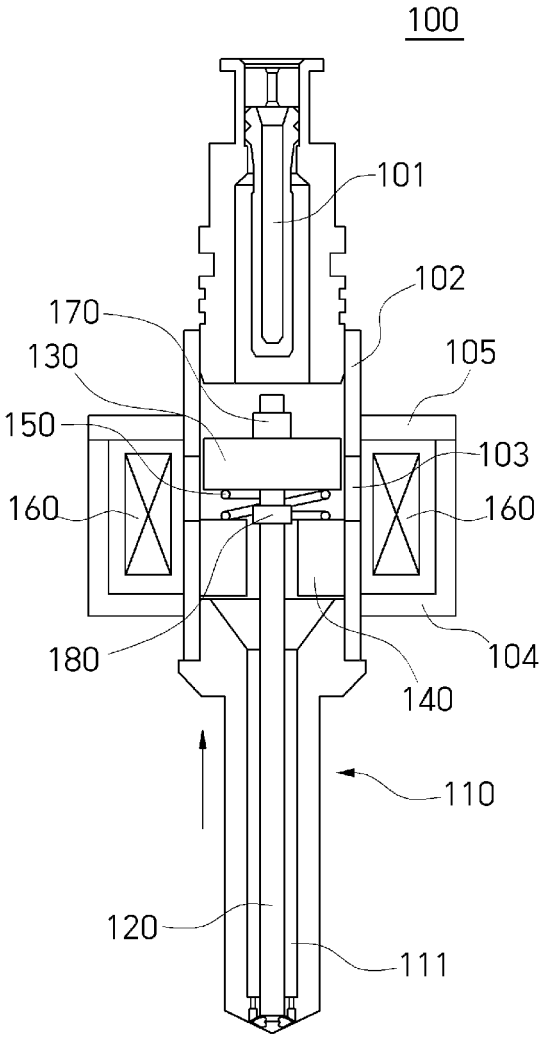

That is, when the angle between the fins 123 can be adjusted, an injection amount of the vehicle fuel can be adjusted. Meanwhile, as shown in FIG. 7B, airtight portions 125 are provided at both ends of the blades 122 of the needle bar 120.

FIGS. 8A to 8E are sets of views illustrating operation mechanisms of the vehicle fuel injector according to one embodiment of the present disclosure.

Referring to FIGS. 8A to 8E, the vehicle fuel injector 100 operates according to steps a, b, c, d, and e.

The step a is a pre-operation step in which the armature 130 restricted by the stopper 170 receives a force from the elastic member 150 in an upward direction. As a result, when the armature 130 is in contact with the stopper 170, airtightness between the nozzle 110 and the needle bar 120 is maintained.

In the step b, the needle bar 120 of the vehicle fuel injector 100 in which an induced magnetic force is generated moves downward so that the nozzle 110 enters an initial open state.

In this case, when an electrical signal is applied to the vehicle fuel injector 100 in which the induced magnetic force is generated due to the solenoid coil 160, the armature 130 moves toward the magnetic core 140 and collide with the position ring 180. Next, the armature 130 moves downward with the needle bar 120 until the elastic member 150 is compressed.

In this case, the needle bar 120 reciprocally and vertically moves on the inner circumferential surface of the nozzle 110 in conjunction with the nozzle 110, and rotation thereof is adjusted in the left or right direction. Accordingly, the needle bar 120 opens or closes the nozzle 110.

In the step c, when the needle bar 120 moves downward, a lower end portion of the nozzle 110 is opened as rotation of the needle bar 120 is adjusted in conjunction with the nozzle 110. Accordingly, the discharge flow path 111 and the outward flow path are simultaneously opened so that the vehicle fuel is injected.

In the step d, when the electrical signal is not applied to the armature 130, the magnetic force is removed, and the armature 130 is moved upward by the elastic member 150. In this case, the armature 130 returns to an initial position at which the armature 130 is in contact with the stopper 170 like the step e.

In the state in which the armature 130 is in contact with the stopper 170, the needle bar 120 moves upward and rotates in conjunction with the nozzle 110.

Accordingly, the needle bar 120 maintains a state in which the nozzle 110 is closed until the electricity is applied to the armature 130.

Figure 9A:
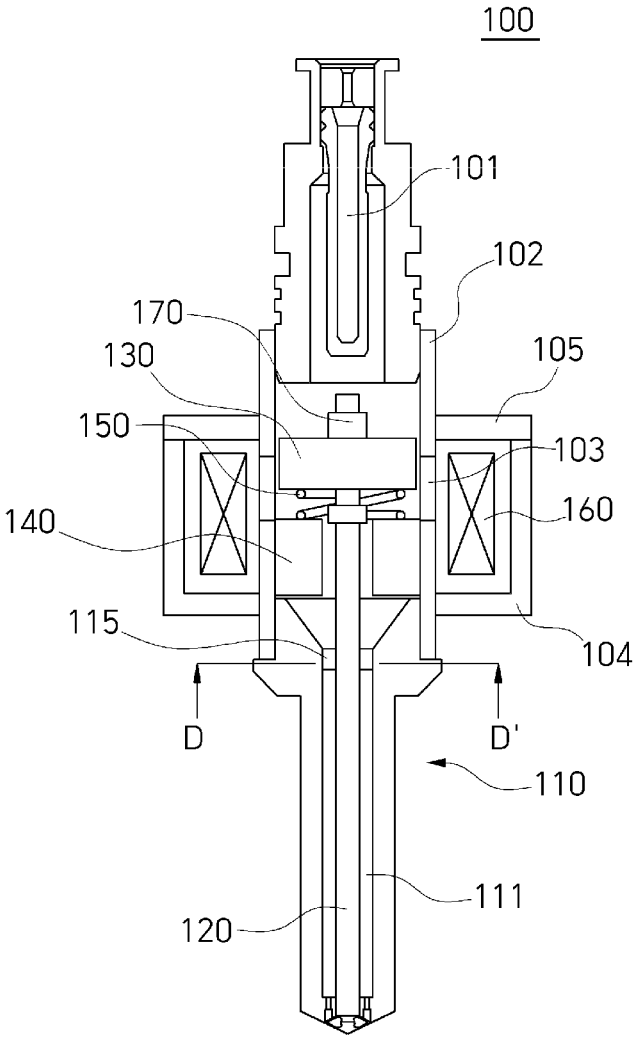
FIGS. 9A and 9B are schematic cross-sectional views of a vehicle fuel injector according to another embodiment of the present disclosure.
Figure 9B:
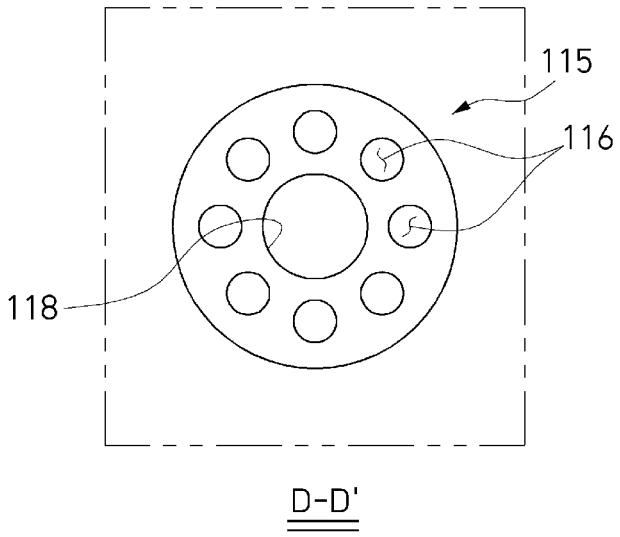

FIGS. 9A and 9B are schematic cross-sectional views of a vehicle fuel injector according to another embodiment of the present disclosure.

Referring to FIGS. 9A and 9B, in a vehicle fuel injector 100 according to another embodiment of the present disclosure, a ring guide 115 is formed on an upper end of an inner circumferential surface of a nozzle 110.

That is, the ring guide 115 which surrounds a circumference of a needle bar 120 to stabilize movement of the needle bar 120 is formed at the upper end of the inner circumferential surface of the nozzle 110.

In this case, the ring guide 115 is formed to have a hollow shape surrounding the circumference of the needle bar 120. In this case, a guide surface 118 which is an inner circumferential surface of the ring guide 115 is in contact with the needle bar 120.

The ring guide 115 includes a plurality of discharge holes 116 having a concentric circle. The discharge holes 116 are connected to discharge flow paths 111 and outward flow paths of the nozzle 110 to provide discharge paths of a vehicle fuel.

Figure 10:
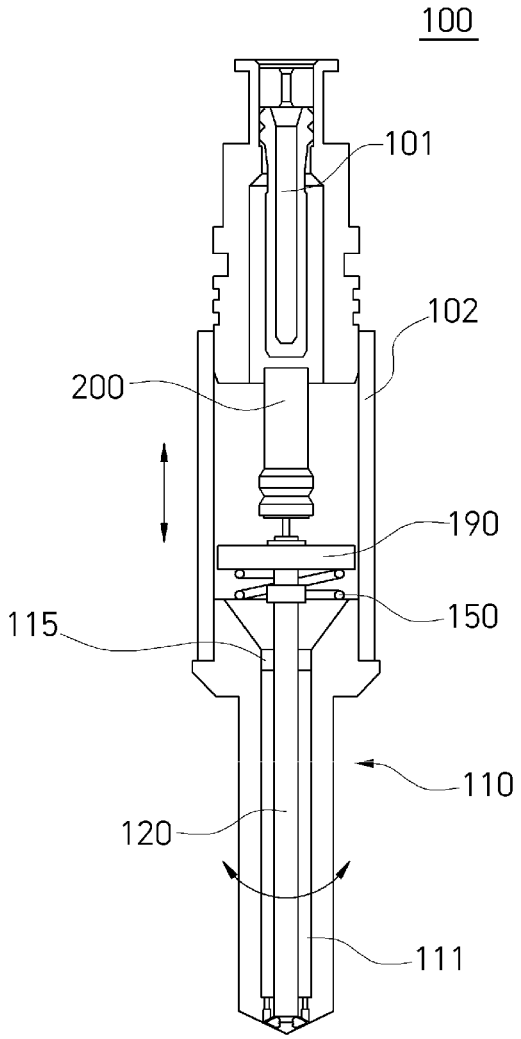
FIG. 10 is a schematic cross-sectional view of a vehicle fuel injector and coupling relationships between components of the vehicle fuel injector according to still another embodiment of the present disclosure.

FIG. 10 is a schematic cross-sectional view of a vehicle fuel injector and coupling relationships between components of the vehicle fuel injector according to still another embodiment of the present disclosure.

Referring to FIG. 10, in a vehicle fuel injector 100 according to still another embodiment of the present disclosure, a piezo actuator 200 is used instead of a solenoid coil.

The piezo actuator 200 is connected to an upper end of a needle bar 120 and controls movement of the needle bar 120.

A fixing plate 190 and an elastic member 150 are disposed between the piezo actuator 200 and a nozzle 110.

The fixing plate 190 surrounds an upper circumference of the needle bar 120.

The elastic member 150 is provided between the fixing plate 190 and an upper end portion of the nozzle 110 and provides an elastic force.

In this case, a ring guide 115 which surrounds a circumference of the needle bar 120 to stabilize movement of the needle bar 120 is formed at an upper end of an inner circumferential surface of the nozzle 110.

According to the present disclosure, fuel can be injected to a suitable injection reach distance and injection targeting performance can be improved using a nozzle in which an outward flow path and a multi-hole type discharge flow path are mixed.

Accordingly, the present disclosure can reduce exhaust emissions and prevent a knocking phenomenon by reducing a wall wetting fuel stream phenomenon in a combustion chamber.

The present disclosure is not limited to the above-described embodiments and may be variously modified and implemented in a range in which the technical spirit of the present disclosure allows.

What is claimed is:

1. A vehicle fuel injector provided for injecting a high-pressure vehicle fuel received from a fuel rail into a combustion chamber, the vehicle fuel injector comprising:

a nozzle which includes a plurality of discharge flow paths which are disposed to be spaced apart from each other in a circumferential direction and pass through the nozzle in a longitudinal direction, and outward flow paths formed on an inner circumferential surface of the nozzle, the nozzle having a hollow shape; and a needle bar which is formed to pass through the inner circumferential surface of the nozzle and vertically reciprocally moves on the inner circumferential surface of the nozzle, wherein rotation of the needle bar is adjusted in a left or right direction so that the nozzle is opened or closed.

2. The vehicle fuel injector of claim 1, wherein:

the nozzle includes a guide protrusion formed to protrude from the inner circumferential surface of the nozzle;

the needle bar includes a guide groove corresponding to the guide protrusion on an outer circumferential surface of the needle bar; and the guide groove is concavely formed to be inclined in a downward direction and adjusts a rotation angle of the needle bar.

3. The vehicle fuel injector of claim 2, wherein the guide groove includes:

a vertical groove having a vertical section on the outer circumferential surface of the needle bar; and an inclined groove formed to extend from the vertical groove and inclined in a left or right direction with respect to the vertical groove.

4. The vehicle fuel injector of claim 2, wherein:

the needle bar rotates such that the nozzle enters an open state while moving downward; and the needle bar rotates such that the nozzle enters a closed state while moving upward.

5. The vehicle fuel injector of claim 1, wherein in the nozzle, choking occurs in the discharge flow path so that fuel is injected at a constant speed.

6. The vehicle fuel injector of claim 1, wherein a plurality of blades is formed to protrude in a width direction on a lower end of the needle bar.

7. The vehicle fuel injector of claim 6, wherein a blade of the plurality of blades includes a pair of fins formed to protrude from an upper end surface of the blade and spaced apart from each other to form an acute angle therebetween.

8. The vehicle fuel injector of claim 7, wherein the pair of fins provides a discharge path of one of the outward flow paths on the blade in an open state of the nozzle and atomize an injected fuel.

9. The vehicle fuel injector of claim 1, wherein a guide member which surrounds and supports a circumference of the needle bar to stabilize movement of the needle bar is formed at a lower end of the inner circumferential surface of the nozzle.

10. The vehicle fuel injector of claim 9, wherein:

the guide member is formed to protrude inward at a position corresponding to the discharge flow path in a width direction; and the outward flow paths are formed at both ends of the guide member in the circumferential direction.

11. The vehicle fuel injector of claim 1, wherein a ring guide which surrounds and supports a circumference of the needle bar to stabilize movement of the needle bar is formed on an upper end of the inner circumferential surface of the nozzle.

12. The vehicle fuel injector of claim 11, wherein the ring guide is formed to have a hollow shape of which an inner circumferential surface surrounds the circumference of the needle bar and includes a plurality of discharge holes having a concentric circle.

13. The vehicle fuel injector of claim 1, further comprising:

an armature surrounding an upper circumference of the needle bar;

a magnetic core positioned under the armature and disposed around the needle bar; and an elastic member provided between the armature and the magnetic core.

14. The vehicle fuel injector of claim 13, wherein:

the armature moves downward in a direction toward the magnetic core due to a magnetic field generated in a solenoid coil; and the needle bar moves vertically in conjunction with the armature.

15. The vehicle fuel injector of claim 14, wherein a non-magnetic body is provided at a partial section between the armature and the solenoid coil.

16. The vehicle fuel injector of claim 13, wherein:

a stopper disposed above the armature and a position ring disposed under the armature are formed on the upper circumference of the needle bar; and the stopper and the position ring are formed to be spaced apart from each other to restrict a movement range of the armature.

17. A vehicle fuel injector provided for injecting a high-pressure vehicle fuel received from a fuel rail into a combustion chamber, the vehicle fuel injector comprising:

a nozzle having a hollow shape; and a needle bar which vertically reciprocally moves on an inner circumferential surface of the nozzle, wherein rotation of the needle bar is adjusted in a left or right direction so that the nozzle is opened or closed, wherein a guide protrusion is formed to protrude from the inner circumferential surface of the nozzle, a guide groove corresponding to the guide protrusion is provided on an outer circumferential surface of the needle bar, and the guide groove is concavely formed to be inclined in a downward direction and adjusts a rotation angle of the needle bar.

18. A vehicle fuel injector provided for injecting a high-pressure vehicle fuel received from a fuel rail into a combustion chamber, the vehicle fuel injector comprising:

a nozzle which includes a plurality of discharge flow paths which are disposed to be spaced apart from each other in a circumferential direction and pass through the nozzle in a longitudinal direction, and outward flow paths formed on an inner circumferential surface of the nozzle, the nozzle having a hollow shape;

a needle bar which is formed to pass through the inner circumferential surface of the nozzle and vertically reciprocally moves on the inner circumferential surface of the nozzle, wherein rotation of the needle bar is adjusted in a left or right direction so that the nozzle is opened or closed; and a piezo actuator connected to an upper end of the needle bar to control movement of the needle bar.

19. The vehicle fuel injector of claim 18, further comprising:

a fixing plate which surrounds an upper circumference of the needle bar; and an elastic member which is provided between the fixing plate and an upper end of the nozzle and provides an elastic force.

20. The vehicle fuel injector of claim 18, wherein a ring guide which surrounds and supports a circumference of the needle bar to stabilize movement of the needle bar is formed on an upper end of the inner circumferential surface of the nozzle.

* * * * *